US007831187B2

(12) United States Patent
Kang et al.

(10) Patent No.: US 7,831,187 B2
(45) Date of Patent: Nov. 9, 2010

(54) FUSING UNIT HAVING A HIGH THERMAL EFFICIENCY AND IMAGE FORMING APPARATUS INCLUDING THE SAME

(75) Inventors: Dong-kyun Kang, Goyang-si (KR); Dong-jin Seol, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 744 days.

(21) Appl. No.: 11/832,930

(22) Filed: Aug. 2, 2007

(65) Prior Publication Data

US 2008/0112737 A1 May 15, 2008

(30) Foreign Application Priority Data

Nov. 10, 2006 (KR) ..... 10-2006-0111015

(51) Int. Cl.
*G03G 15/20* (2006.01)

(52) U.S. Cl. ..... 399/328; 219/216; 399/329

(58) Field of Classification Search ..... 399/328, 399/329, 333; 219/216, 619
See application file for complete search history.

(56) References Cited

U.S. PATENT DOCUMENTS 7,212,775 B2 * 5/2007 Kachi ..... 399/329
2006/0140691 A1 6/2006 Kim et al.

FOREIGN PATENT DOCUMENTS

| | | |
|---|---|---|
| JP | 11-352812 | 12/1999 |
| KR | 2005-60488 | 6/2005 |
| KR | 2006-75131 | 7/2006 |

* cited by examiner

*Primary Examiner*—William J Royer
(74) *Attorney, Agent, or Firm*—Staas & Halsey LLP

(57) ABSTRACT

A fusing unit of an image forming apparatus includes a first rotating member which heats toner applied to a printing medium, a heatable member to heat the first rotating member, which is disposed to be independent of rotation of the first rotating member and which is heatable by an induction current, a pressing member which presses the first rotating member, and an induction heating part which is disposed inside the pressing member, which induces the induction current to the heatable member.

26 Claims, 10 Drawing Sheets

FUSING UNIT HAVING A HIGH THERMAL EFFICIENCY AND IMAGE FORMING APPARATUS INCLUDING THE SAME

CROSS-REFERENCE TO RELATED APPLICATION

This application claims the benefit of Korean Application No. 2006-111015, filed Nov. 10, 2006 in the Korean Intellectual Property Office, the disclosure of which is incorporated herein by reference.

BACKGROUND OF THE INVENTION

1. Field of the Invention

Aspects of the present invention relate to a fusing unit and an image forming apparatus including the same, and more particularly, to a fusing unit having a high thermal efficiency and an image forming apparatus including the same.

2. Description of the Related Art

In general, a fusing unit performs a fusing process in an electrophotographic type image forming apparatus, which forms an image on a printing medium by performing a series of processes, including exposing a toner image, developing the toner image, transferring the toner image to the printing medium, and fusing the toner image. The fusing unit fuses toner, which is initially applied to the printing medium in a liquid state, onto the printing medium by heat and pressure so that the toner hardens on the printing medium.

As shown in FIG. 1, a conventional fusing unit 10 includes a pair of rollers including a heating roller 13 and a pressing member 17. The heating roller 13 and the pressing member 17 include cylindrical metal rotating bodies 131 and 171 which are rotatably supported by bearings 135 and 175, respectively, and elastic layers 132 and 172 formed of an elastic material on a circumference of the metal rotating bodies 131 and 171, respectively. Also, halogen lamps 133 and 173 are located inside the metal rotating bodies 131 and 171 and held in position in hollow glass pipes 134 and 174, respectively. A fusing nip surface, which is a common contact area where the heating roller 13 and the pressing member 17 contact each other, is heated to a predetermined fusing temperature by radiant heat generated by the halogen lamps 133 and 173. The halogen lamps 133 and 173 are supplied with electric power by electrode brushes 136 and 176, respectively.

However, since the conventional fusing unit 10 has airspace F and the elastic layers 132 and 172 located between the fusing nip surface and the halogen lamps 133 and 173, heat is lost during the fusing process, thereby lowering thermal efficiency.

To improve thermal efficiency, an induction heating type fusing unit, which uses an induction coil in addition to the halogen lamps 133 and 173 used by the above-described lamp heating type fusing unit 10, has been developed. The induction heating type fusing unit disclosed in Korean Patent Publication No. 2005-60488 has a more improved thermal efficiency than the lamp heating type fusing unit 10 described above. However, the induction heating type fusing unit heats an entire circumference of a heating roller, even though only a fusing nip portion is used to fuse the toner to the printing medium, thereby lowering thermal efficiency. Accordingly, when the induction heating type fusing unit is heated up, the entire circumference of the heating roller is heated, which has a large thermal capacity. As a result, the induction heating type fusing unit takes a long time to reach a fusing temperature.

SUMMARY OF THE INVENTION

Accordingly, aspects of the present invention provide a fusing unit which enhances thermal efficiency and reduces a time period in which the fusing unit reaches a fusing temperature, and an image forming apparatus including the same.

According to an aspect of the present invention, a fusing unit of an image forming apparatus includes a first rotating member which heats toner applied to a printing medium, a heatable member to heat the first rotating member, which is disposed to be independent from a rotation of the first rotating member and which is heatable by an induction current, a pressing member which presses against the first rotating member, and an induction heating part which is disposed inside the pressing member, which induces the induction current to the heatable member.

According to an aspect of the invention, the heatable member is disposed inside the first rotating member.

According to an aspect of the invention, the heatable member is disposed adjacent to a fusing nip formed between the first rotating member and the pressing member where the pressing member presses the first rotating member.

According to an aspect of the invention, the pressing member includes a second rotating member, and an elastic layer which is wrapped around an outer circumferential area of the second rotating member, and the induction heating part comprises an induction coil which is wound inside the second rotating member.

According to an aspect of the invention, the fusing unit of an image forming apparatus further includes an insulating member which is disposed inside the second rotating member and wrapped around the induction coil.

According to an aspect of the invention, the induction coil is disposed to be independent from a rotation of the second rotating member.

According to an aspect of the invention, the induction coil is disposed to maintain a constant position adjacent to a fusing nip formed between the first rotating member and the pressing member.

According to an aspect of the invention, the first rotating member is a conveyor belt made out of a thermally conductive film.

According to another aspect of the invention, a fusing unit of an image forming apparatus includes a first rotating member which heats toner applied to a printing medium, a heatable member to heat the first rotating member and which is heatable by an induction current, a pressing member which presses against the heatable member, and an induction heating part which is disposed inside the pressing member, which induces the induction current to the heatable member, wherein the heatable member is a metal film which is wrapped around the first rotating member.

According to another aspect of the invention, the metal film comprises at least one of copper, nickel, steel, and chrome.

According to another aspect of the present invention, an image forming apparatus includes a first rotating member which heats toner on a printing medium, a heatable member which is disposed to be independent from a rotation of the first rotating member and which is heatable by an induction current, a pressing member which presses against the first rotating member, an induction heating part which is disposed inside the pressing member, which induces the induction current to the heatable member, and a power supplying part which supplies power to the induction heating part to generate the induction current.

According to another aspect of the invention, the heatable member is disposed adjacent to a fusing nip formed between the first rotating member and the pressing member where the pressing member presses against the first rotating member.

According to another aspect of the invention, the pressing member includes a second rotating member and an elastic layer which is wrapped around an outer circumferential area of the second rotating member, and the induction heating part includes an induction coil which is wound inside the second rotating member.

According to another aspect of the invention, the induction coil is disposed to be independent from a rotation of the second rotating member.

According to another aspect of the invention, the induction coil is disposed adjacent to the fusing nip formed between the first rotating member and the pressing member.

According to another aspect of the invention, the image forming apparatus further includes an insulating member which is disposed inside the pressing member and is wrapped around the induction coil.

According to another aspect of the invention, the heatable member includes at least one of copper, nickel, steel, and chrome.

According to another aspect of the invention, the first rotating member is a conveyor belt made out of a thermally conductive film.

According to another aspect of the invention, an image forming apparatus includes a first rotating member which heats toner on a printing medium, a heatable member to heat the first rotating member and which is heatable by an induction current, a pressing member which presses against the heatable member, an induction heating part which is disposed inside the pressing member, which induces the induction current to the heatable member, and a power supplying part which supplies power to the induction heating part to generate the induction current, wherein the heatable member includes a metal film which is wrapped around the first rotating member.

According to another aspect of the invention, the metal film includes at least one of copper, nickel, steel, and chrome.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
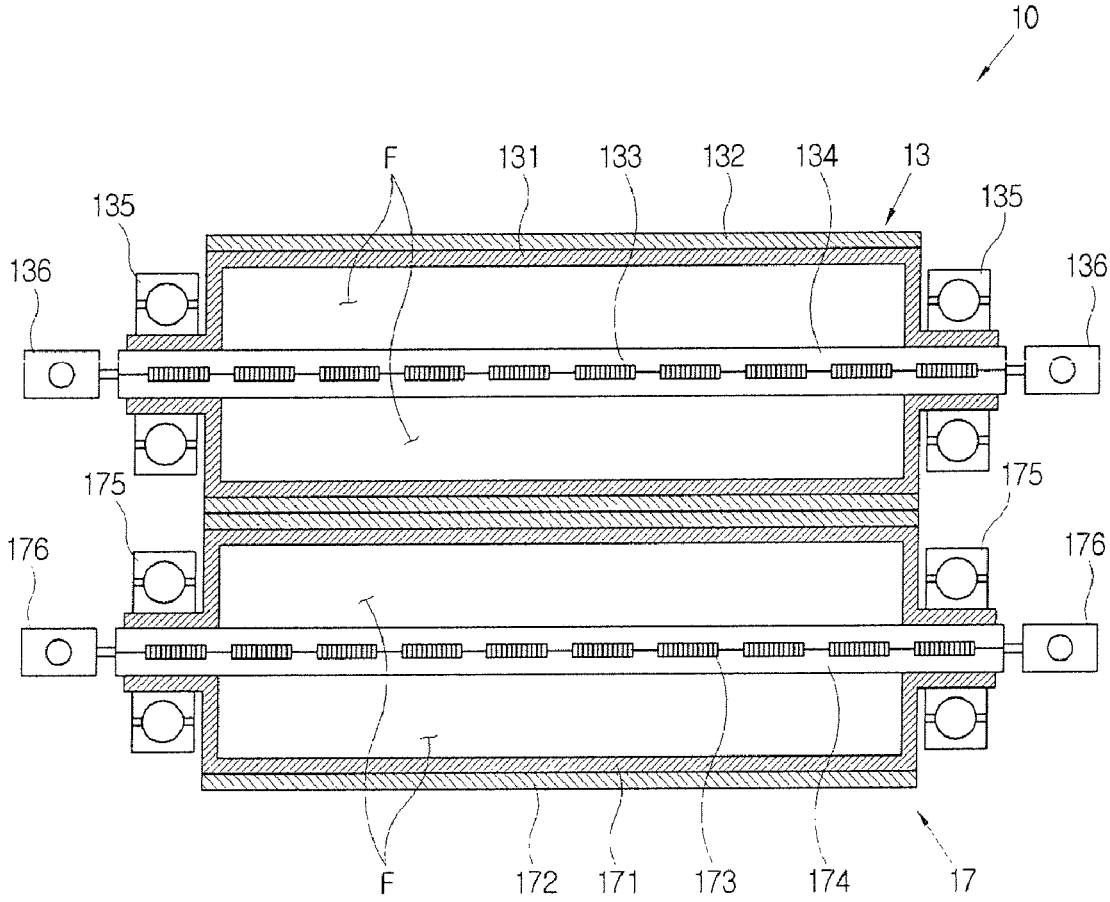
FIG. 1 (RELATED ART)
FIG. 1 is a schematic sectional view of a conventional fusing unit.

Reference will now be made in detail to the present embodiments of the present invention, examples of which are illustrated in the accompanying drawings, wherein like reference numerals refer to like elements throughout. The embodiments are described below in order to explain the present invention by referring to the figures.

Figure 2:
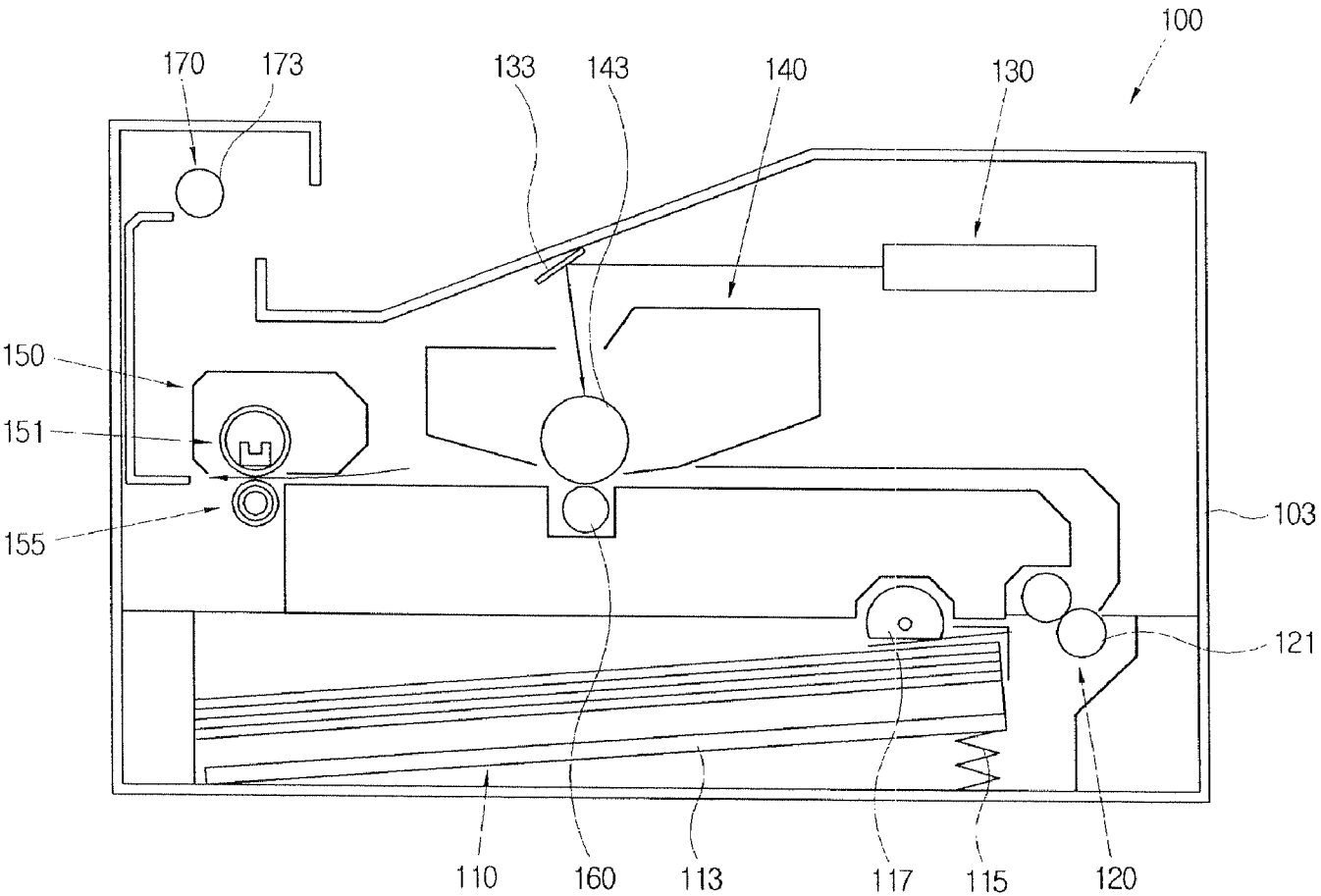
FIG. 2 is a sectional view of an image forming apparatus according to an embodiment of the present invention.

As shown in FIG. 2, an image forming apparatus 100 according to aspects of the present invention includes a housing 103, a feeding part 110, a paper transferring part 120, a light scanning unit 130, a developing unit 140, a fusing unit 150, a transferring part 160, and a discharging part 170. It is understood that the image forming apparatus 100 may have a variety of other components not shown in FIG. 2.

Printing media, such as sheets of paper, transparency sheets, etc., are stored on a feeding cassette 113 which is elastically supported by a spring 115. Sheets of the printing media are individually picked up by a pick up roller 117. The picked-up printing medium passes through a pair of transferring rollers 121 which transfers the printing medium toward the developing unit 140. A leading edge of the printing medium is aligned by a registration roller (not shown). Light irradiated by the light scanning unit 130 is reflected from a reflection mirror 133, such as a polygon mirror, and scanned on a surface of a photosensitive drum 143 of the developing unit 140. An electrostatic latent image is formed on the surface of the photosensitive drum 143 and the electrostatic latent image is developed by a developing roller (not shown) which develops the electrostatic latent image into a toner image. The developed toner image is transferred to the printing medium at the transferring part 160 by an electric attraction, and the transferred toner image is fused on the printing medium by the fusing unit 150. The printing medium with the fused toner image is discharged by a discharging roller 173 located in the discharging part 170 to the outside of the image forming apparatus 100. According to aspects of the present invention, the transferring part 160 is provided as a roller type transferring part 160, such as a transferring roller, or a belt type transferring part 160, such as a transferring belt.

Figure 4:
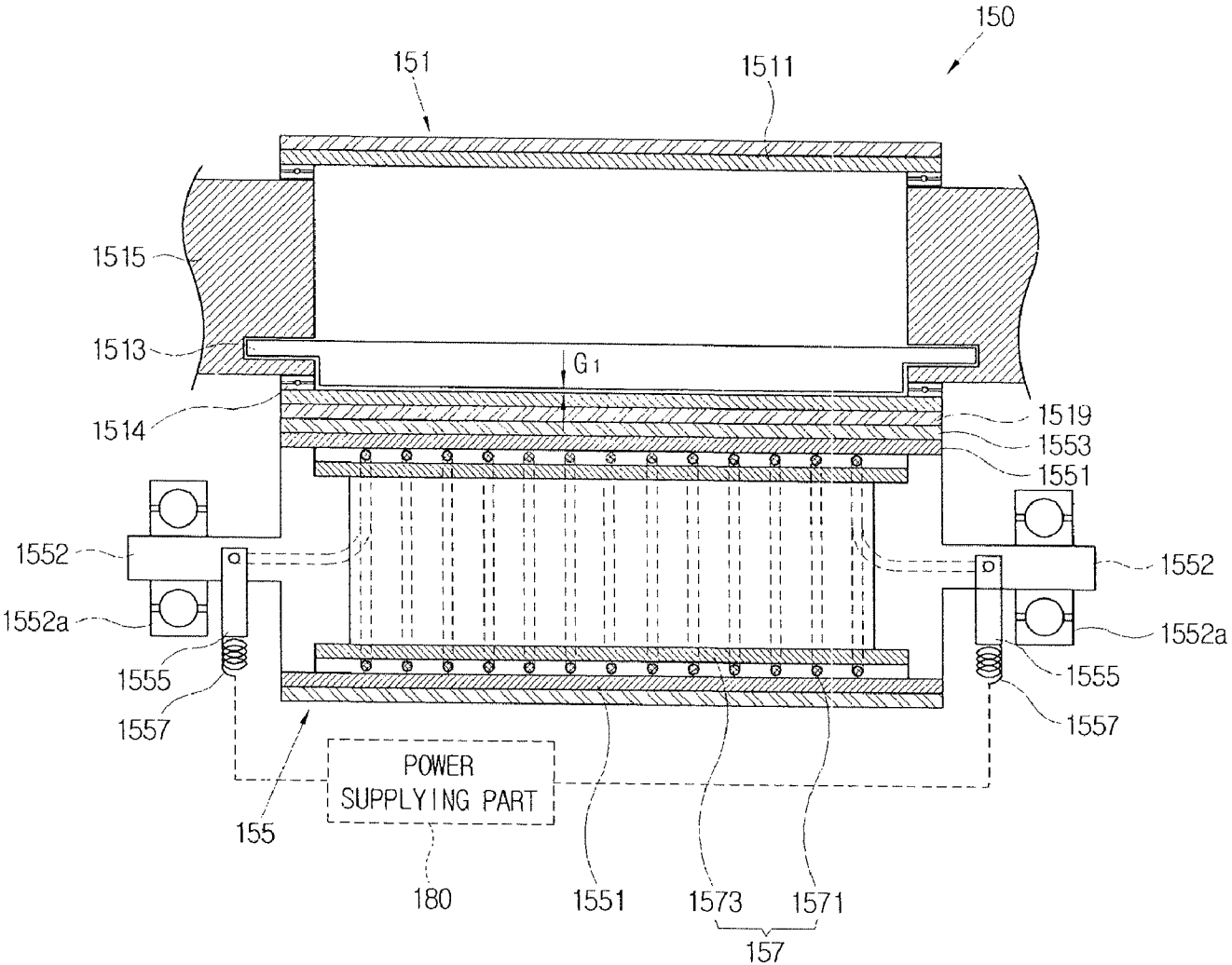
FIG. 4 is a cross sectional view of the fusing unit shown in FIG. 3.

Also, as shown in FIG. 4, the image forming apparatus 100 according to an embodiment of the present invention further includes a power supplying part 180. The power supplying part 180 supplies current, which is switched in frequency from tens of kilohertz (kHz) to hundreds of kilohertz (kHz), to an induction coil 1571 described later. The power supplying part 180 includes a high frequency oscillatory AC power circuit to generate the high frequency switching current. It is understood that components other than a high frequency oscillatory AC power circuit may instead be used to generate the high frequency switching current.

Figure 3:
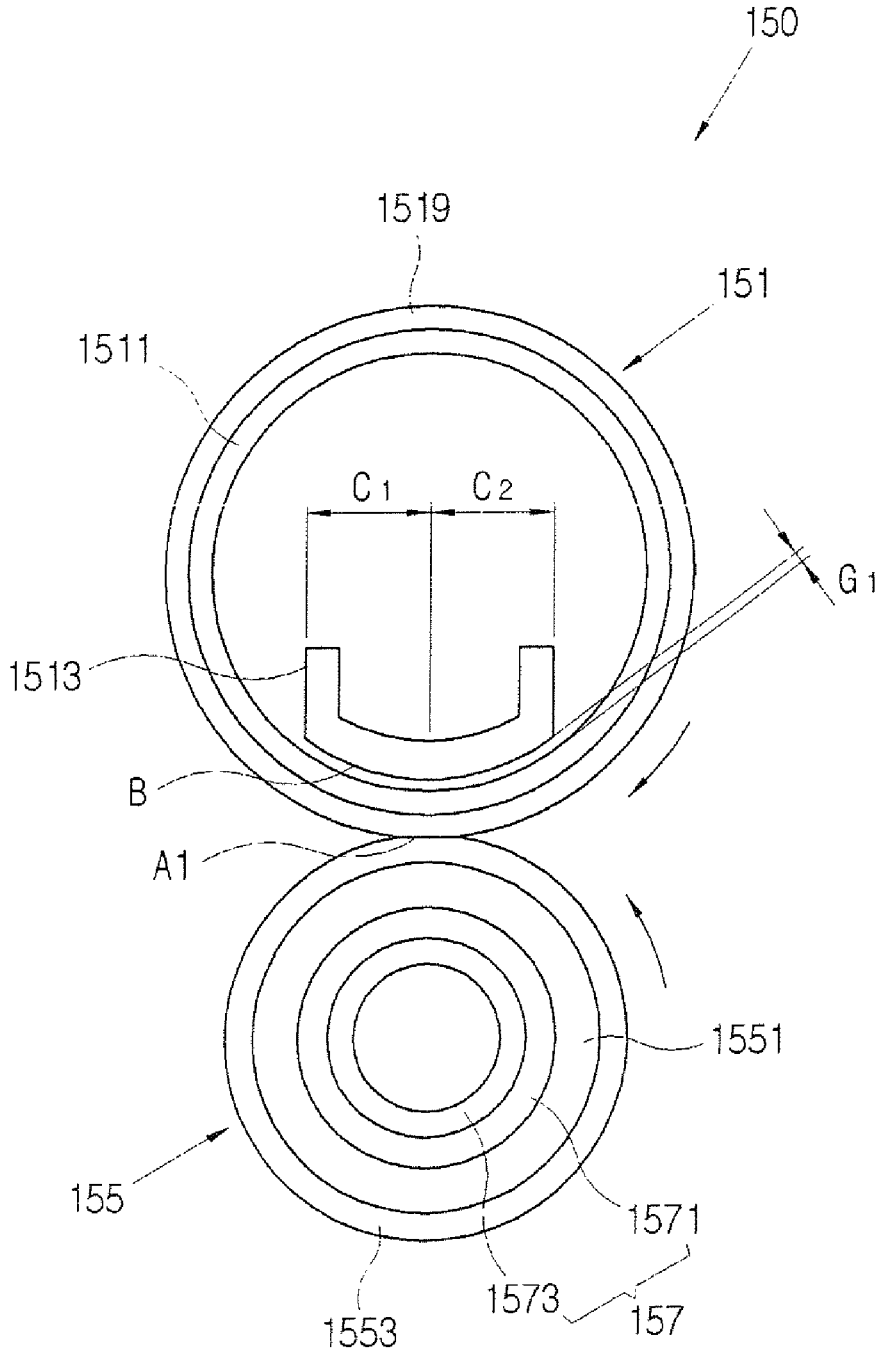
FIG. 3 is a sectional view of a fusing unit according to a first embodiment of the present invention.

As shown in FIGS. 3 and 4, the fusing unit 150 according to a first embodiment of the present invention includes a heating roller 151, a pressing member 155, and an induction heating part 157. The heating roller 151 includes a first rotating member 1511 which is rotatable, a to-be-heated member 1513, also known as a heatable member 1513, which is disposed inside the first rotating member 1511, and an elastic layer 1519 which is wrapped around an outer circumference of the first rotating member 1511.

According to an aspect of the present invention, the first rotating member 1511 is embodied as a hollow metal cylinder and is made of a material having a high thermal conductivity, such as aluminum, stainless steel or copper. Also, the elastic layer 1519 is wrapped around a circumference of the first rotating member 1511. Furthermore, the elastic layer 1519 is made of a silicon rubber material or urethane within a thickness range of 300 μm to 5 mm. According to another aspect, the elastic layer 1519 is removed entirely.

The to-be-heated member 1513, which is also referred to as a heatable member 1513, is heated by an induction (or eddy) current generated by a high frequency magnetic field within the induction coil 1571, which is described later. The to-be-heated member 1513 is made of a material which has a large thermal efficiency, such as at least one of copper, nickel, steel, and chrome. However, it is understood that the to-be-heated member 1513 is not limited to the above kinds of metals and is further not limited to being made out of metal, but may be embodied as any material so long as the induction current can be transmitted to the to-be-heated member 1513.

In addition, the to-be-heated member 1513 is disposed to be adjacent to a fusing nip A1, which is a common contact area between the heating roller 151 and the pressing member 155, to minimize thermal loss. The to-be-heated member 1513 is disposed to be separate from the rotating of the first rotating member 1511. As shown in FIG. 4, opposite end parts of the to-be-heated member 1513 project to the outside of the heating roller 151 where the opposite end parts are fixed on a frame 1515. The first rotating member 1511 can be rotated by a frictional force between the pressing member 155 and the first rotating member 1511 as the heating roller 151 is driven to be rotated. A bearing 1514 may be inserted between the first rotating member 1511 and the frame 1515. Further, as shown in FIG. 4, openings may be cut in the heating roller 151 for the opposite ends parts of the to-be-heated member 1513 to project through. The openings may be various types, such as, for example, a circular opening which allows the heating roller 151 to rotate without touching the opposite end parts of the to-be-heated member 1513. Accordingly, the to-be-heated member 1513 is disposed to maintain a constant position which is adjacent to the fusing nip A1 regardless of whether the heating roller 151 is rotating, thereby minimizing thermal loss and reducing a time period in which the fusing unit 15 reaches the fusing temperature. It is understood that the to-be-heated member 1513 may be fixed to the frame 1515 in many different ways, for example, by screws, bolts, fasteners, adhesives, etc.

Also, as shown in FIG. 3, a surface B of the to-be-heated member 1513 facing the first rotating member 1511 has a larger width than the width of the fusing nip A1. Furthermore, in the to-be-heated member 1513, a portion of the to-be heated member 1513 corresponding to the arrow C2 has a larger width than a portion of the to-be-heated member 1513 corresponding to the arrow C1. By doing so, more heat is generated in the portion of the to-be-heated member 1513 corresponding to C2, which is located before the fusing nip A1 along a feeding path which the printing medium moves through, and thus, the to-be-heated member 1513 is fully preheated before the printing medium reaches the fusing nip A1. Furthermore, the to-be-heated member 1513 may be designed in various shapes and sizes without being limited to the shape and size illustrated in FIG. 3. For example, a curvature of the surface B of the to-be-heated member 1513 is not limited to corresponding to a curvature of the heating roller 151, and is further not limited to being curved at all.

Also, the to-be-heated member 1513 is disposed inside the first rotating member 1511 so as to minimize the size of the entire fusing unit 150. In addition, the to-be-heated member 1513 is located in a position to maintain a predetermined space G1 between the first rotating member 1511 and the to-be-heated member 1513 so that the first rotating member 1511 and the to-be-heated member 1513 do not interfere with each other. According to an aspect, the predetermined space G1 is set to be small so as to minimize thermal loss.

Alternatively, according to another aspect, a surface roughness of the surface B of the to-be-heated member 1513 facing the first rotating member 1511 and a surface roughness of an inner circumference surface of the first rotating member 1511 are reduced so that the first rotating member 1511 easily slides past the to-be-heated member 1513, thereby allowing the predetermined space G1 to be removed completely. Also, by coating the surface B of the to-be-heated member 1513 with any of a variety of materials, such as, for example, Teflon®, frictional heat is generated between the surface B and the inner circumference surface of the first rotating member 1511.

The pressing member 155 includes a second rotating member 1551 which is rotated by power transmitted from a power source (not shown), and an elastic layer 1553 which is wrapped around an outer circumference of the second rotating member 1551. Shaft bushings 1552 are inserted into opposite end sides of the second rotating member 1551, and a bearing 1552*a* supports each of the shaft bushings 1552 so that the second rotating member 1551 is slidably movable within the fusing unit 150. It is understood that the second rotating member 1551 is not limited to being attached to the image forming apparatus with shaft bushings 1552 and bearings 1552*a*, and may instead be attached with various different types of fasteners.

According to an aspect, the second rotating member 1551 is embodied as a hollow metal cylinder made out of a metal having a high thermal conductivity, such as aluminum, stainless steel, or copper. Alternatively, according to another aspect, the second rotating member 1551 is formed out of an insulating material, such as mica, polyimide, ceramic, or glass, to prevent the high frequency alternating current applied to the induction coil 1571 from leaking to the outside of the fusing unit 150.

As shown in FIGS. 3 and 4, the induction heating part 157 includes the induction coil 1571 and a core 1573. The induction heating part 157 integrally rotates with the pressing member 155.

Copper wire, nickel wire, litz wire, or a combination thereof is used to make the induction coil 1571. Also, when nickel wire or copper wire is used, additional heat is generated by the induction coil 1571. In FIG. 4, the induction coil 1571 is wound along the circumferential direction of the core 1573, but it is understood that the induction coil 1571 may be wound in various directions so long as the induction current is generated and transmitted to the to-be-heated member 1513. The power supplying part 180 transmits alternating current through a conductive elastic member 1557 and a brush 1555 to the induction coil 1571. The elastic members 1557 fixed to opposite ends of the pressing member 155 elastically pull the pressing member 155 toward the heating roller 151. It is understood that the elastic members 1557 may instead be fixed to opposite ends of the heating roller 151, and that components besides the elastic members 1557 may instead be used to bias the pressing member 155 toward the heating roller 151, such as hydraulic, pneumatic, or pulley systems.

According to an aspect, the core 1573 is formed out of magnetic material such as ferrite, a metal such as aluminum, or an insulating material so as to insulate the induction coil 1571. Alternatively, according to another aspect, the core 1573 is removed and the induction coil 1571 is adhered to the inner circumference of the second rotating member 1551.

Figure 5:
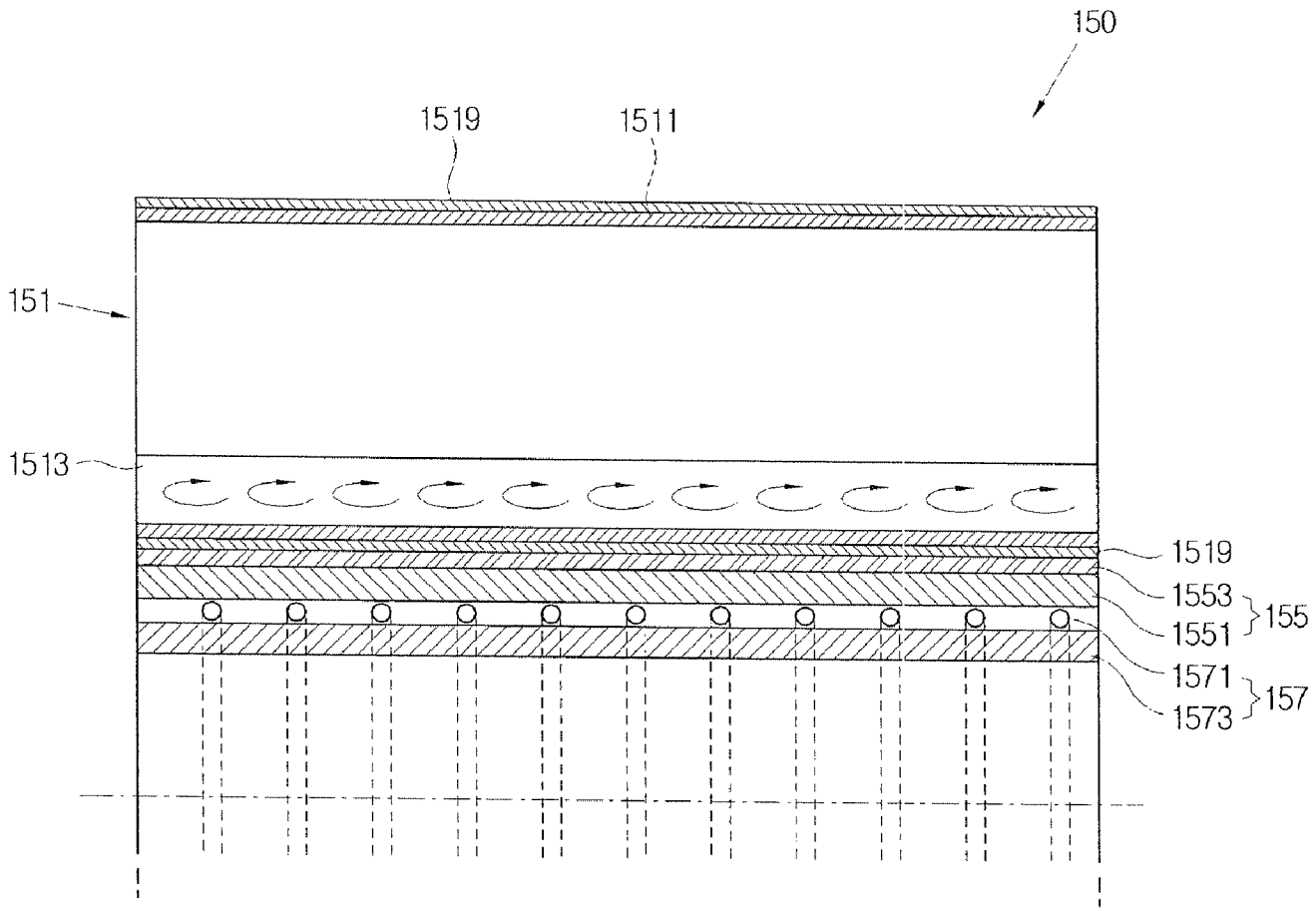
FIG. 5 is a schematic cross sectional view illustrating the principle of how the fusing unit shown in FIG. 3 operates.

Hereinafter, a heat-generation process of the fusing unit 150 will be described by referring to FIG. 5. If a surface temperature of the fusing nip A1 is lower than a predetermined fusing temperature controlled by a thermistor (not shown), the power supplying part 180 (shown in FIG. 4) applies a high frequency current to the induction coil 1571, and the induction coil 1571 generates an alternating magnetic field. An induction current is generated in a direction which counterbalances the magnetic field, and the to-be-heated member 1513 is heated by the induction current. Also, Joule's heat is generated inside the induction coil 1571 in the pressing member 155 by an electric resistance of the induction coil 1571.

Accordingly, as the to-be-heated member 1513, which maintains a constant position adjacent to the fusing nip (see A1 in FIG. 3) inside the heating roller 151, is heated by the induction current, the temperature around the fusing nip A1 rapidly increases. Also, since the pressing member 155 is heated by Joule's heat generated by resistance of the induction coil 1571, the thermal loss for the pressing member 155 is reduced. Furthermore, since there is little to no airspace between the to-be-heated member 1513 and the fusing nip A1, the thermal loss caused by the airspace is also reduced. Accordingly, the fusing unit 150 has a small size and an improved thermal efficiency. It is understood, however, that the to-be-heated member 1513 is not required to be heated by induction heating, and may instead be heated by other methods known in the art.

Figure 6:
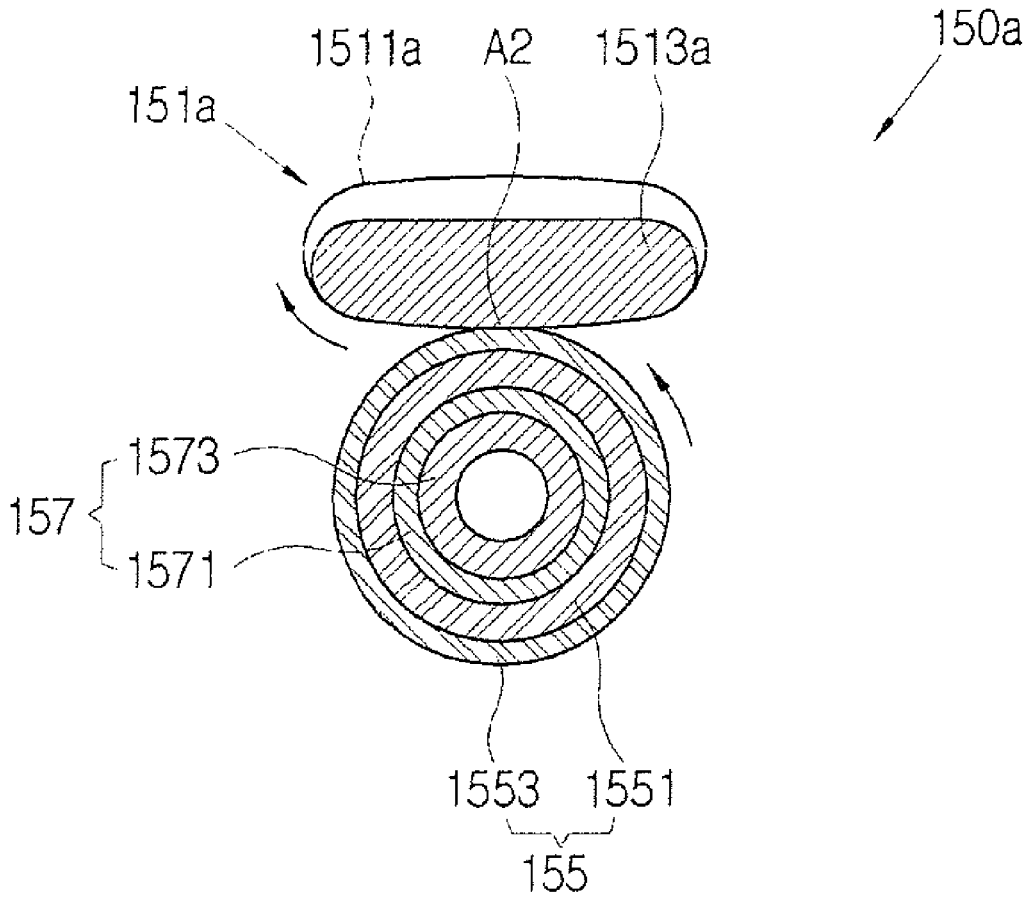
FIG. 6 is a sectional view of a fusing unit according to a second embodiment of the present invention.

As shown in FIG. 6, a fusing unit 150*a* according to a second embodiment of the present invention includes a heating roller 151*a* with distinct characteristics in comparison to the heating roller 151 of the first embodiment. The heating roller 151*a* includes a to-be-heated member 1513*a* and a first rotating member 1511*a*.

The first rotating member 1511*a* is embodied as a conveyor belt formed out of a film made of a thermally conductive material. The first rotating member 1511*a* is in contact with the pressing member 155 and rotates with the pressing member 155 due to a frictional force generated between the first rotating member 1511*a* and the pressing member 155. Opposite end parts of the to-be-heated member 1513*a* have a curved surface to smoothly rotate the first rotating member 1511*a*. Since a fusing nip A2 is formed by a common contact area where the to-be-heated member 1513*a* and the pressing member 155 contact each other, the fusing nip A2 is larger than the fusing nip A1 (FIG. 3) because the fusing nip A2 is flattened, or in other words, shaped like a conveyor belt. The fusing capacity of the fusing unit 150*a* is thereby improved by enlarging the fusing nip A2.

Figure 7:
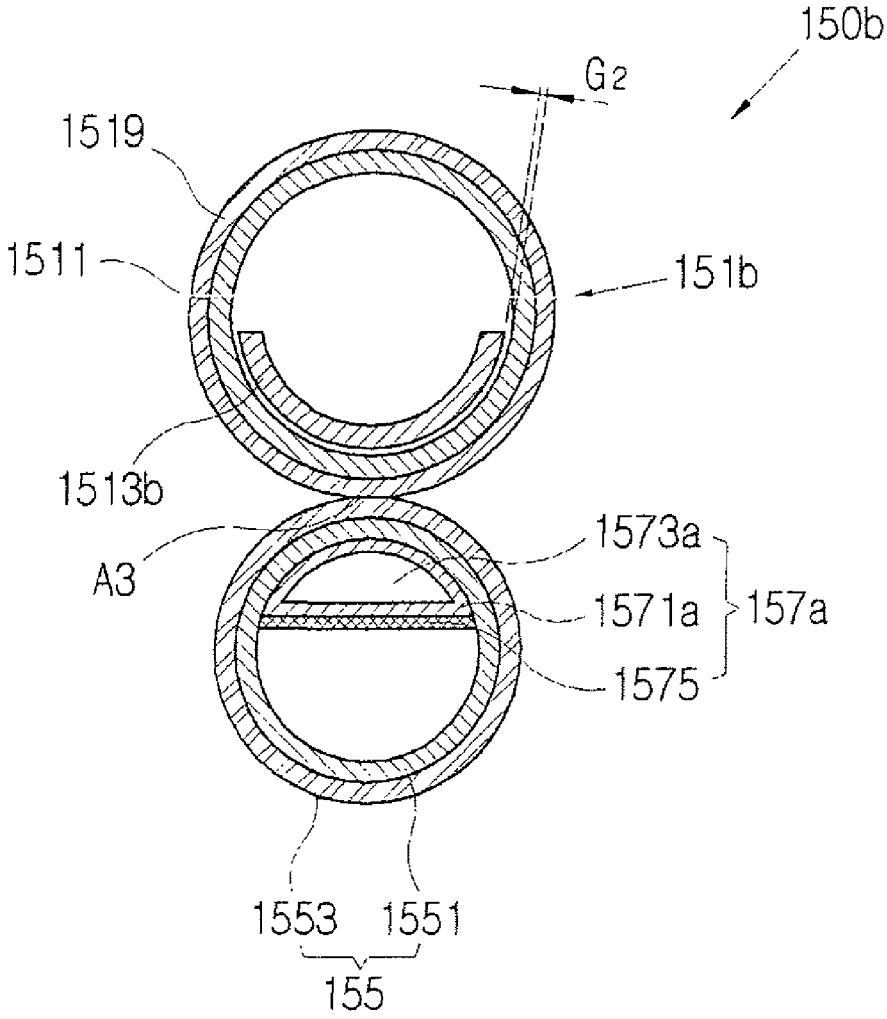
FIG. 7 is a sectional view of a fusing unit according to a third embodiment of the present invention.
Figure 8:
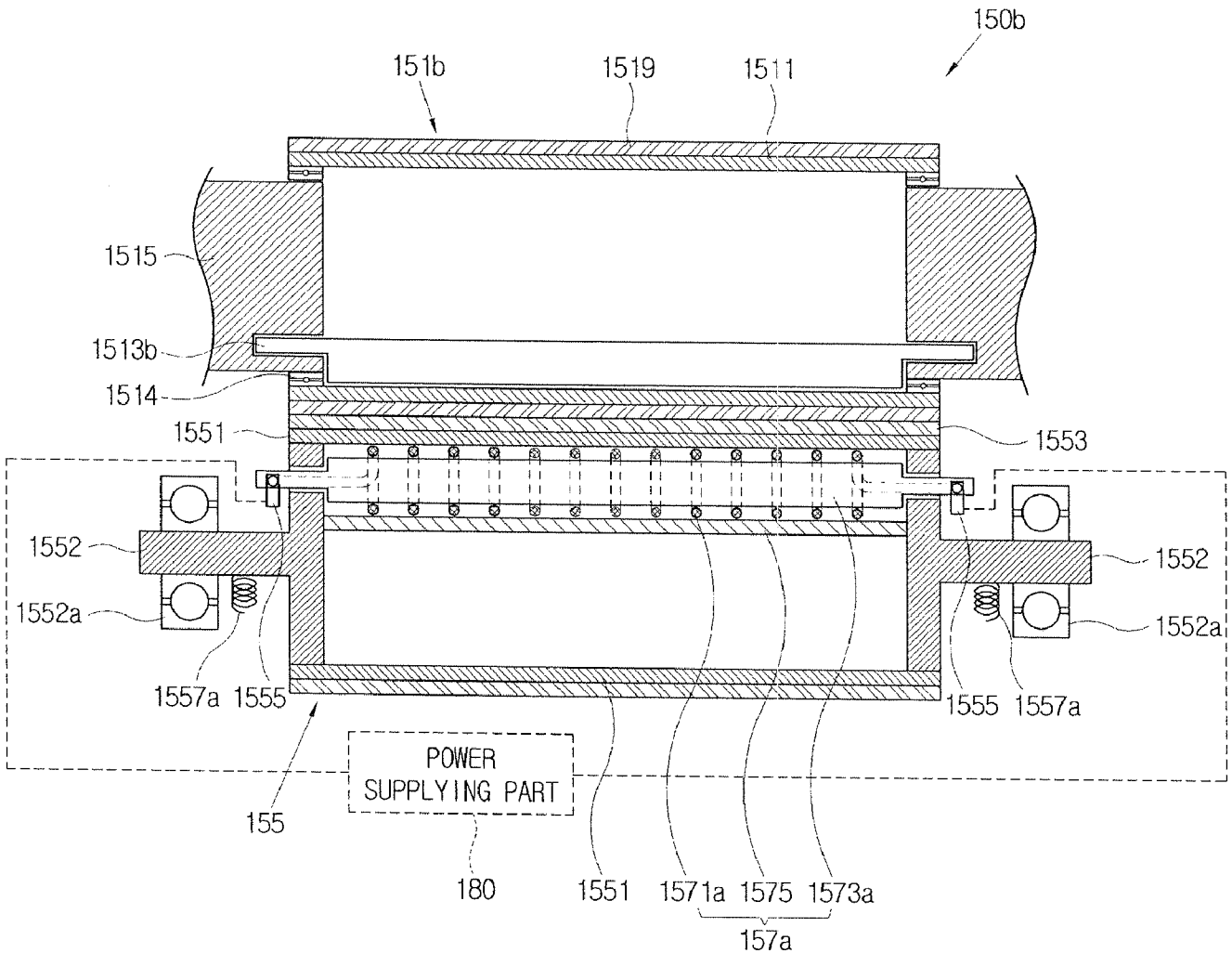
FIG. 8 is a cross sectional view of the fusing unit shown in FIG. 7.

Meanwhile, as shown in FIGS. 7 and 8, a fusing unit 150*b* according to a third embodiment of the present invention includes a heating roller 151*b* and an induction heating part 157*a* with distinct characteristics in comparison to the fusing unit 150 of the first embodiment and 150*a* of the second embodiment.

The heating roller 151*b* includes a to-be-heated member 1513*b* which has an arc-shaped section. It is understood, however, that the heating roller 151*b* is not limited to having an arc shape, and may have various shapes instead of the arc shape. Also, the to-be-heated member 1513*b* is disposed inside the first rotating member 1511 and is independent from the rotation of the first rotating member 1511. The to-be-heated member 1513*b* and the first rotating member 1511 are separated from each other by a predetermined space G2. However, as described above with reference to the first embodiment, the first rotating member 1511 is not limited to being spaced apart from the to-be-heated member 1513*b*, and may instead rotate by sliding past the to-be-heated member 1513*b* by lowering a surface roughness of the first rotating member 1511 and the to-be-heated member 1513*b*.

As shown in FIG. 8, the induction heating part 157*a* includes an induction coil 1571*a*, a core 1573*a* and an insulating member 1575. The insulating member 1575 is disposed to maintain a constant position independent of the rotation of the second rotating member 1551. As shown in FIG. 7, the insulating member 1575 is disposed in a flat board shape, but may instead be disposed in other shapes and position, for example, the insulating member 1575 may be wrapped around the induction coil 1571*a*. According to another aspect, the insulating member 1575 may be completely removed.

The induction coil 1571*a* is configured to be independent from the rotation of the second rotating member 1551, which is a distinct feature in comparison with the induction coils 1571 of the first and the second embodiments. In other words, although the second rotating member 1551 is rotatable, the induction coil 1571*a* is configured to maintain a constant position. As shown in FIG. 8, the opposite end parts of the core 1573*a* project outside of the pressing member 155 and are fixed to a frame (not shown).

Specifically, the induction coil 1571*a* in the third embodiment is disposed to maintain a constant position adjacent to a fusing nip A3, which is distinct in comparison to the induction coil 1571 disposed along the entire circumference of the second rotating member 1551 in the first and second embodiments. By being positioned adjacent to the fusing nip A3 regardless of the rotation of the pressing member 155, the induction heating part 157*a* rapidly brings the temperature of the fusing nip A3 to the fusing temperature.

In addition, an elastic member 1557*a* is made out of a conductive material, such as metal, since the elastic member 1557*a* is not connected to a power supplying part 180 and therefore will not interfere with the generation of the induction current. According to an aspect, the elastic member 1557*a* is embodied as a spring. However, the elastic member 1557*a* is not limited to being a spring, and may instead be various other devices which bias the pressing member 155 into the heating roller 151*b*, such as a pneumatic or hydraulic device, a pulley system, etc.

Figure 9:
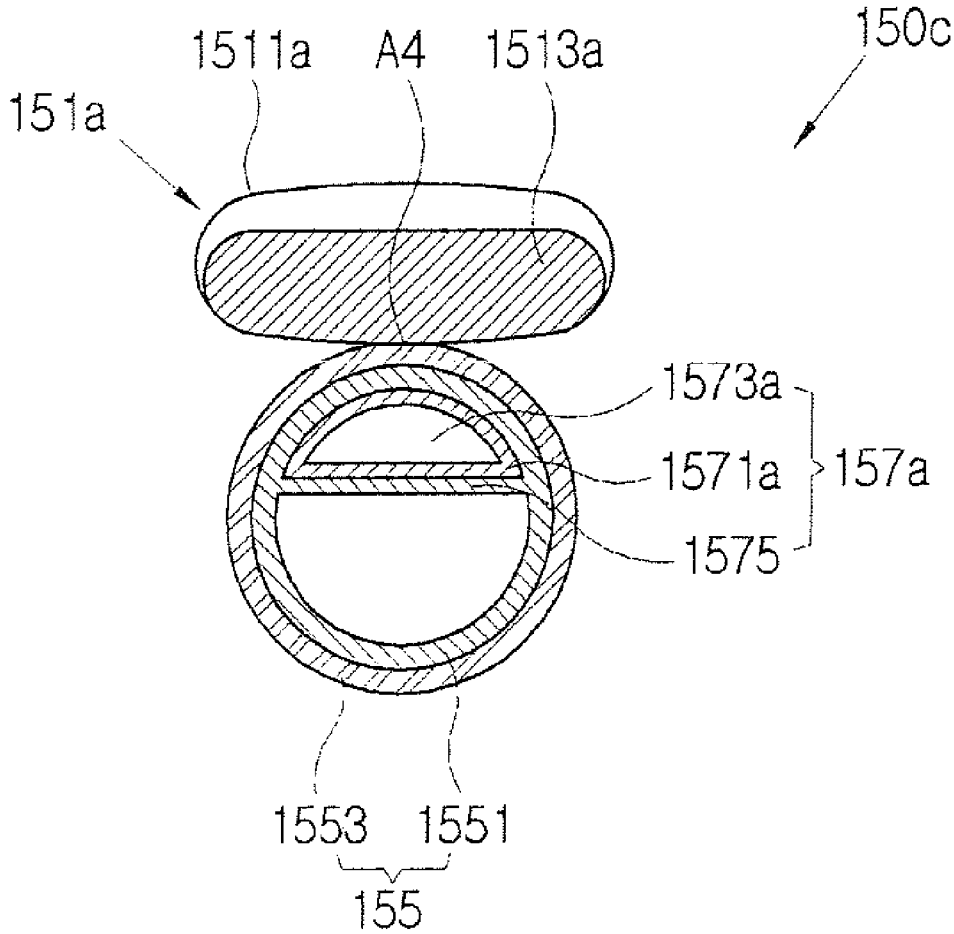
FIG. 9 is a sectional view of a fusing unit according to a fourth embodiment of the present invention.

Meanwhile, as shown in FIG. 9, a fusing unit 150*c* according to a fourth embodiment of the present invention includes a heating roller 151*a* and an induction heating part 157*a* with distinct characteristics in comparison to the fusing units 150, 150*a* and 150*b* of the first, second and third embodiments. A description of the heating roller 151*a* and the induction heating part 157*a* will be omitted as it has been described above. In the fusing unit 150*c*, the width of a fusing nip A4 is enlarged by flattening a surface of the to-be-heated member 1513*a* facing the pressing member 155, and the induction heating part 157*a* is disposed to maintain a constant position adjacent to the fusion unit A4 regardless of a rotation of the second rotating member 1551, thereby shortening a time period in which the fusing unit 150*c* reaches the fusing temperature.

Figure 10:
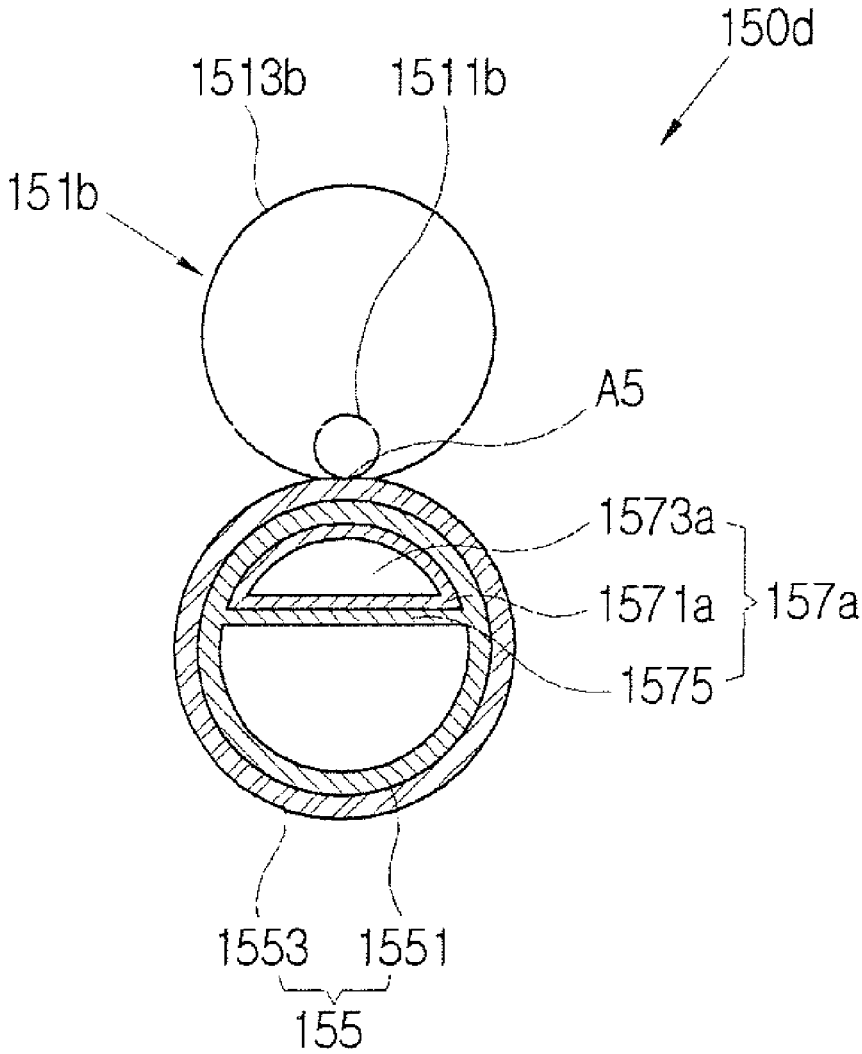
FIG. 10 is a sectional view of a fusing unit according to a fifth embodiment of the present invention.

As shown in FIG. 10, a fusing unit 150*d* according to a fifth embodiment of the present invention includes a heating roller 151*b* and an induction heating part 157*a* with distinct characteristics in comparison to the fusing units 150, 150*a*, 150*b* and 150*c* of the first, second, third and fourth embodiments. The heating roller 151*b* includes a first rotating member 1511*b* and a to-be-heated member 1513*b*. The first rotating member 1511*b* is disposed inside the to-be-heated member 1513*b* and forms a fusing nip A5 with a pressing member 155. The to-be-heated member 1513*b* is embodied as a belt having a metal film made of any of various types of materials, such as copper, nickel, steel, chrome, etc. which are heatable by an induction current. The to-be-heated member 1513*b* is rotated in contact with the pressing member 155 by a frictional force therebetween. A description of the induction heating part 157*a* will be omitted since the induction heating part 157*a* has been described above.

As described above, the fusing unit according to aspects of the present invention and the image forming apparatus including the fusing unit produce the following beneficial results. First, the to-be-heated members 1513, 1513*a* and 1513*b* are each disposed to maintain a constant position adjacent to a fusing nip, thereby minimizing thermal loss caused by air space. Second, the to-be-heated members 1513, 1513*a* and 1513*b* are each maintained to be adjacent to the fusing nip while being independent of the rotation of the first rotating members 1511, 1511*a* and 1511*b*, thereby shortening a time period in which the fusing nip reaches a fusing temperature. Third, the pressing member 155 is heated by Joule's heat generated in the induction coil 1571 and 1571*a*, thereby reducing thermal loss caused by the pressing member 155. Fourth, the induction heating parts 157 and 157*a* are disposed inside the pressing member 155 while maintaining a constant position adjacent to a fusing nip and independent of the rotation of the pressing member 155, thereby reducing a size of the fusing units 150, 150*a*, 150*b*, 150*c* and 150*d*.

Although a few embodiments of the present invention have been shown and described, it would be appreciated by those skilled in the art that changes may be made in this embodiment without departing from the principles and spirit of the invention, the scope of which is defined in the claims and their equivalents. Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A fusing unit of an image forming apparatus, comprising:

a first rotating member which heats toner applied to a printing medium;

a heatable member to heat the first rotating member, which is disposed to be independent from a rotation of the first rotating member and which is heatable by an induction current;

a pressing member which presses against the first rotating member; and an induction heating part which is disposed inside the pressing member, which induces the induction current to the heatable member.

2. The fusing unit of an image forming apparatus according to claim 1, wherein the heatable member is disposed inside the first rotating member.

3. The fusing unit of an image forming apparatus according to claim 2, wherein the heatable member is disposed adjacent to a fusing nip formed between the first rotating member and the pressing member where the pressing member presses against the first rotating member.

4. The fusing unit of an image forming apparatus according to claim 2, wherein the pressing member comprises:

a second rotating member, and an elastic layer which is wrapped around an outer circumferential area of the second rotating member; and the induction heating part comprises an induction coil which is wound inside the second rotating member.

5. The fusing unit of an image forming apparatus according to claim 4, further comprising an insulating member which is disposed inside the second rotating member and wrapped around the induction coil.

6. The fusing unit of an image forming apparatus according to claim 4, wherein the induction coil is disposed to be independent from a rotation of the second rotating member.

7. The fusing unit of an image forming apparatus according to claim 4, wherein the induction coil is disposed to maintain a constant position adjacent to a fusing nip formed between the first rotating member and the pressing member.

8. The fusing unit of an image forming apparatus according to claim 2, wherein the first rotating member comprises a belt made out of a thermally conductive film.

9. The fusing unit of an image forming apparatus of claim 1, wherein the heatable member has a cylindrical shape and opposite end parts projecting outside of respective openings in the first rotating member, and each of the opposite end parts is fixed to a frame of the image forming apparatus so that the heatable member maintains a constant position.

10. The fusing unit of an image forming apparatus of claim 1, wherein the induction heating part has a cylindrical shape and opposite end parts projecting outside of respective openings in the pressing member, and each of the opposite end parts is fixed to a frame of the image forming apparatus.

11. The fusing unit of an image forming apparatus according to claim 10, wherein the induction heating part is fixed in a position adjacent to a fusing nip formed between the first rotating member and the pressing member where the pressing member presses against the first rotating member.

12. A fusing unit of an image forming apparatus, comprising:

a first rotating member which heats toner applied to a printing medium;

a heatable member to heat the first rotating member and which is heatable by an induction current;

a pressing member which presses against the heatable member; and an induction heating part which is disposed inside the pressing member, which induces the induction current to the heatable member, wherein the heatable member comprises a metal film which is wrapped around the first rotating member.

13. The fusing unit of an image forming apparatus according to claim 12, wherein the metal film comprises at least one of copper, nickel, steel, and chrome.

14. An image forming apparatus, comprising:

a first rotating member which heats toner on a printing medium;

a heatable member which is disposed to be independent from a rotation of the first rotating member and which is heatable by an induction current;

a pressing member which presses against the first rotating member;

an induction heating part which is disposed inside the pressing member, which induces the induction current to the heatable member; and a power supplying part which supplies power to the induction heating part to generate the induction current.

15. The image forming apparatus according to claim 14, wherein the heatable member is disposed adjacent to a fusing nip formed between the first rotating member and the pressing member where the pressing member presses against the first rotating member.

16. The image forming apparatus according to claim 14, wherein the pressing member comprises:

a hollow second rotating member, and an elastic layer which is wrapped around an outer circumferential area of the hollow second rotating member; and the induction heating part comprises an induction coil which is wound inside the hollow second rotating member.

17. The image forming apparatus according to claim 16, wherein the induction coil is disposed to be independent of rotation of the second rotating member.

18. The image forming apparatus according to claim 16, wherein the induction coil is disposed adjacent to a fusing nip formed between the first rotating member and the pressing member where the pressing member presses the first rotating member.

19. The image forming apparatus according to claim 16, further comprising an insulating member which is disposed inside the pressing member and wrapped around the induction coil.

20. The image forming apparatus according to claim 14, wherein the heatable member comprises at least one of copper, nickel, steel, and chrome.

21. The image forming apparatus according to claim 14, wherein the first rotating member comprises a conveyor belt made out of a thermally conductive film.

22. The image forming apparatus according to claim 14, wherein the heatable member has a cylindrical shape and opposite end parts projecting outside of respective openings in the first rotating member, and each of the opposite end parts is fixed to a frame of the image forming apparatus so that the heatable member maintains a constant position.

23. The image forming apparatus according to claim 14, wherein the induction heating part has a cylindrical shape and opposite end parts projecting outside of respective openings in the pressing member, and each of the opposite end parts is fixed to a frame of the image forming apparatus.

24. The image forming apparatus according to claim 23, wherein the induction heating part is fixed in a position adjacent to a fusing nip formed between the first rotating member and the pressing member where the pressing member presses against the first rotating member.

25. An image forming apparatus, comprising:

a first rotating member which heats toner on a printing medium;

a heatable member to heat the first rotating member and which is heatable by an induction current;

a pressing member which presses against the heatable member;

an induction heating part which is disposed inside the pressing member, which induces the induction current to the heatable member; and a power supplying part which supplies power to the induction heating part to generate the induction current, wherein the heatable member comprises a metal film which is wrapped around the first rotating member.

26. The image forming apparatus according to claim 25, wherein the metal film comprises at least one of copper, nickel, steel, and chrome.

* * * * *